US009279221B1

(12) United States Patent
Orona et al.

(10) Patent No.: US 9,279,221 B1
(45) Date of Patent: Mar. 8, 2016

(54) PEDESTRIAN BRIDGE

(71) Applicants: Michael Cardona Orona, Rancho Cucamonga, CA (US); Patrick Thomas Healy, Glendora, CA (US); Robert James Voors, Glendora, CA (US)

(72) Inventors: Michael Cardona Orona, Rancho Cucamonga, CA (US); Patrick Thomas Healy, Glendora, CA (US); Robert James Voors, Glendora, CA (US)

( * ) Notice: Subject to any disclaimer, the term of this patent is extended or adjusted under 35 U.S.C. 154(b) by 0 days.

(21) Appl. No.: 14/276,862

(22) Filed: May 13, 2014

(51) Int. Cl.
*E01D 15/00* (2006.01)

(52) U.S. Cl.
CPC ..... *E01D 15/005* (2013.01)

(58) Field of Classification Search
USPC ..... 14/69.5, 73, 72.5; 16/250, 251, 365, 16/366, 404; 104/275; 174/97, 72 R; 277/631, 632; 52/220.1, 220.2, 220.3, 52/220.5
See application file for complete search history.

(56) References Cited

U.S. PATENT DOCUMENTS

| | | | | | |
|---|---|---|---|---|---|
| 426,209 | A * | 4/1890 | McIntyre | 14/69.5 |
| 3,818,528 | A * | 6/1974 | Petersen | 14/69.5 |
| 3,984,891 | A * | 10/1976 | Weinmann | 14/69.5 |
| 5,870,788 | A * | 2/1999 | Witkin | 14/69.5 |
| 5,933,898 | A * | 8/1999 | Estes et al. | 14/69.5 |
| 6,481,036 | B1 * | 11/2002 | Duvall | 14/69.5 |
| 7,082,637 | B1 * | 8/2006 | Griffin | 14/69.5 |
| 7,592,547 | B2 * | 9/2009 | Lubanski | 174/101 |
| 7,674,980 | B2 * | 3/2010 | Lubanski | 174/97 |
| 7,795,535 | B2 * | 9/2010 | Lubanski | 174/97 |
| 8,288,652 | B2 * | 10/2012 | Lubanski | 174/72 R |
| 8,448,278 | B1 * | 5/2013 | Beilstein | 14/69.5 |
| 2002/0092100 | A1 * | 7/2002 | Byrne | 14/69.5 |
| 2007/0246259 | A1 * | 10/2007 | Lubanski | 174/72 R |
| 2010/0290835 | A1 * | 11/2010 | David | 404/25 |
| 2011/0142537 | A1 * | 6/2011 | Byrne | 404/19 |
| 2013/0047351 | A1 * | 2/2013 | Breault | 14/24 |
| 2013/0108363 | A1 * | 5/2013 | Whiteley | 404/25 |

* cited by examiner

*Primary Examiner* — Matthew D Troutman
(74) *Attorney, Agent, or Firm* — Plager Schack, LLP

(57) ABSTRACT

A pedestrian bridge is configured to be portable and expandable. The pedestrian bridge comprises a bridge mechanically coupled to feet and configured to be elevated above a hazard. A front ramp is rotatably coupled to the bridge and configured to be folded upon the bridge making the pedestrian bridge portable. A rear ramp rotatably coupled to the bridge and configured to be folded upon the bridge further making the pedestrian bridge portable.

5 Claims, 4 Drawing Sheets

PEDESTRIAN BRIDGE

BACKGROUND

The embodiments herein relate generally to bridges primary traversed by foot.

Prior to embodiments of the disclosed invention, standing water impeded the safe ingress, egress and movement of pedestrians. In addition to water, many other obstacles can also cause inconvenient or dangerous hazards, trips and falls and potential injury. Embodiments of the disclosed invention solve these problems.

SUMMARY

A pedestrian bridge is configured to be portable and expandable. The pedestrian bridge comprises a bridge mechanically coupled to feet and configured to be elevated above a hazard. A front ramp is rotatably coupled to the bridge and configured to be folded upon the bridge making the pedestrian bridge portable. A rear ramp rotatably coupled to the bridge and configured to be folded upon the bridge further making the pedestrian bridge portable.

In some embodiments, the bridge can further comprise a bridge top side and a bridge bottom side. The front ramp can further comprise a front ramp top side and a front ramp bottom side. The rear ramp can further comprise a rear ramp top side and a rear ramp bottom side. The bridge top side, front ramp top side, and rear ramp top side are each mechanically coupled grip nubs.

In some embodiments the front ramp feet can be mechanically coupled to the front ramp bottom side. The rear ramp feet can be mechanically coupled to the rear ramp bottom side.

In some embodiments, a front ramp hinge slot can be configured within the front ramp. A front bridge hinge slot is configured within the bridge. A front hinge can be joined to the front ramp hinge slot with a front ramp hinge rod and joined to the front bridge hinge slot with a front bridge hinge rod.

In some embodiments, a rear ramp hinge slot can be configured within the rear ramp. A rear bridge hinge slot can be configured within the bridge. A rear hinge can be joined to the rear ramp hinge slot with a rear ramp hinge rod and joined to the rear bridge hinge slot with a rear bridge hinge rod.

A pedestrian bridge can be configured to be portable and expandable. The pedestrian bridge has a first bridge mechanically coupled to feet and configured to be elevated above a hazard. A second bridge can be attached to the first bridge. A front ramp can be rotatably coupled to the bridge and configured to be folded upon the bridge making the pedestrian bridge portable. A rear ramp can be rotatably coupled to the second bridge and configured to be folded upon the bridge further making the pedestrian bridge portable.

In some embodiments, a first bridge front hinge slot can be configured within the first bridge and adjacent to a first bridge front hinge rod hole. A second bridge rear hinge slot can be configured within the second bridge and adjacent to a second bridge rear hinge rod hole. An end connector can be inserted into the first bridge front hinge slot as well as into second bridge rear hinge slot. A front connector slot and a rear connector slot can be configured within the end connector. A first bridge front hinge rod can be inserted through the first bridge front hinge rod hole and into the front connector slot. A second bridge rear hinge rod can be inserted through the second bridge rear hinge rod hole and into the rear connector slot.

In some embodiments, a connector tab can be configured upon the end connector. A center connector having a first tab can be configured to be joined to the connector tab.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
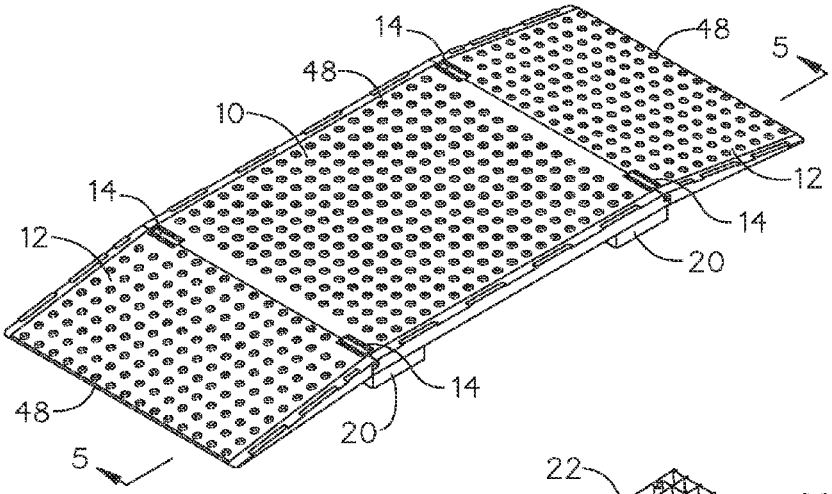
FIG. 1 is a perspective view of an embodiment of the invention in the open position.

By way of example, and referring to FIG. 1, one embodiment of the pedestrian bridge comprises bridge 10 mechanically coupled to front ramp 12 with front hinges 14. Bridge 10 is further mechanically coupled to rear ramp 12 with rear hinges 14. A bridge top side, front ramp top side and rear ramp top side are each mechanically coupled to grip nubs 48.

Figure 2:
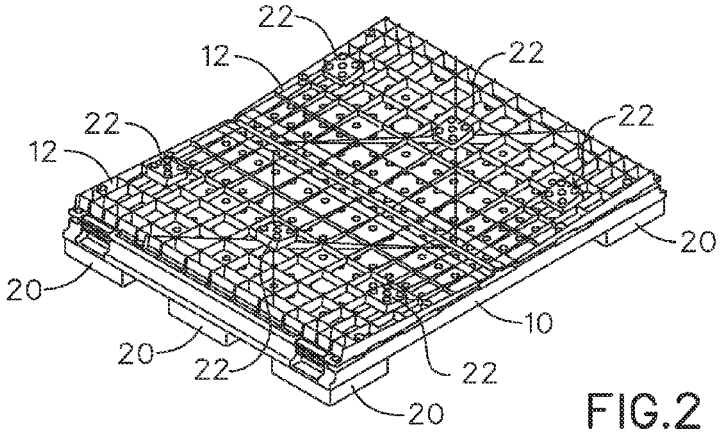
FIG. 2 is a perspective view of an embodiment of the invention in the folded position.
Figure 3:
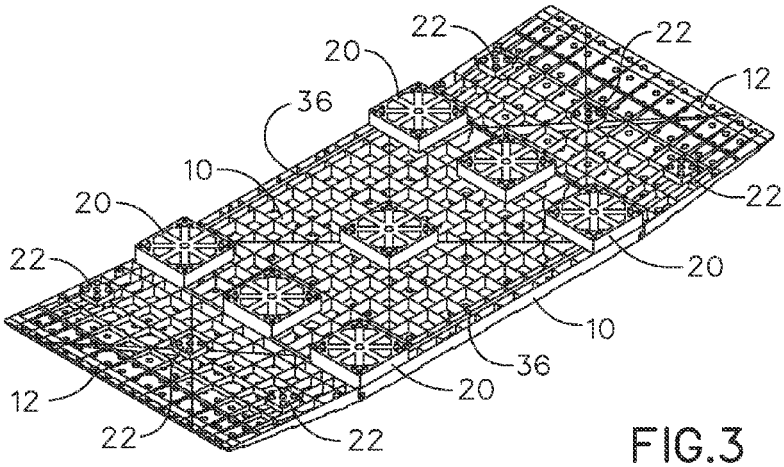
FIG. 3 is a bottom perspective view of an embodiment of the invention in the open position.

FIG. 2 and FIG. 3 show a bridge bottom side, front ramp bottom side and rear ramp bottom side. Bridge 10 has a plurality of bridge rows and columns including cross bar slots 36. Bridge 10 is mechanically coupled to bridge feet 20. Bridge feet 20 lift bridge 10 above the ground and away from a hazard such as standing water. While seven bridge feet 20 are shown, any number can be used. Front ramp 10 has a plurality of front ramp rows and columns. Front ramp 12 is mechanically coupled to front ramp feet 22. While three front ramp feet 22 are shown, any number can be used. Likewise, rear ramp 12 has a plurality of rear ramp rows and columns. Rear ramp 12 is mechanically coupled to rear ramp feet 22. While three rear ramp feet 22 are shown, any number can be used.

Figure 4:
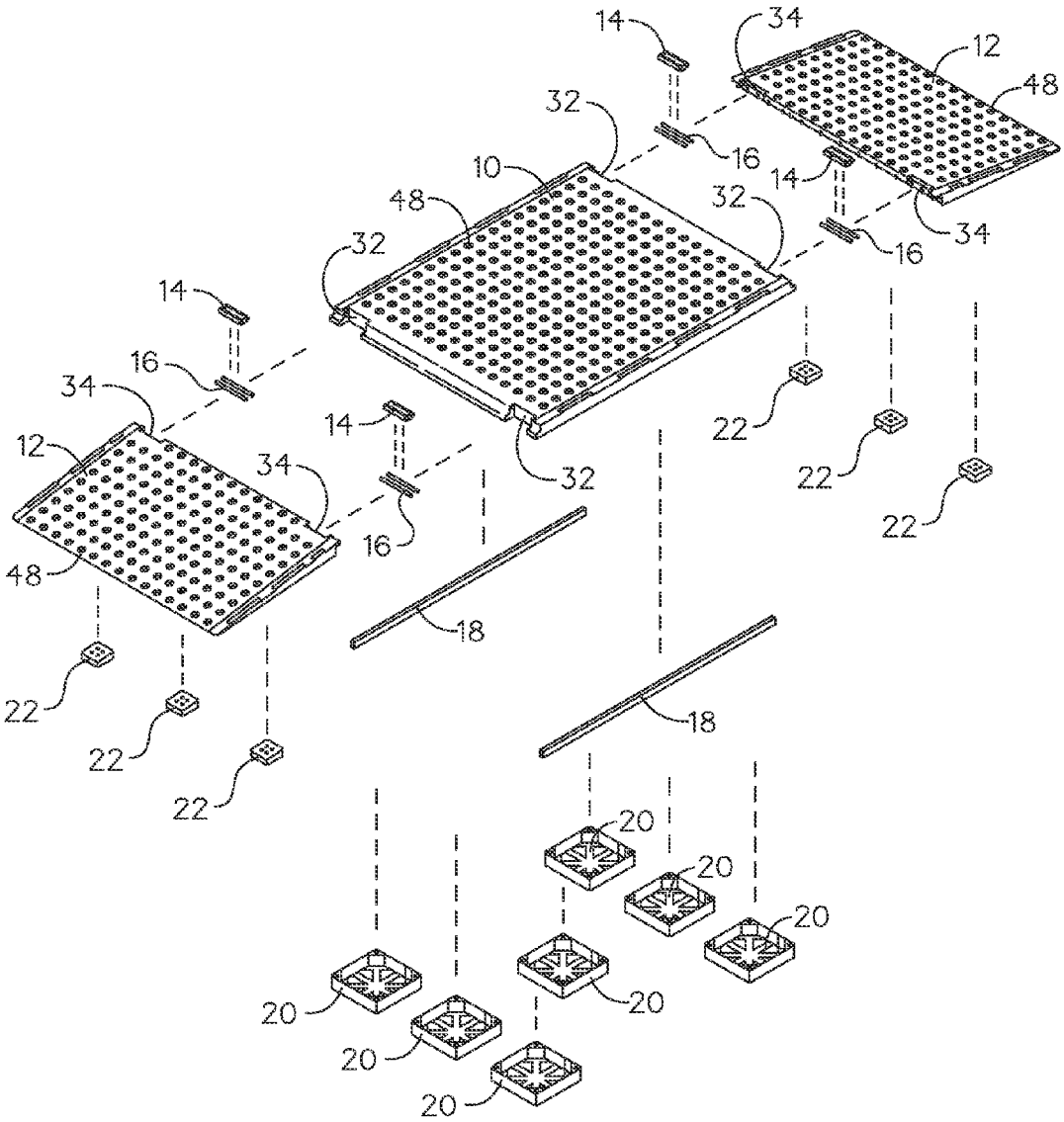
FIG. 4 is an exploded view of an embodiment of the invention, with hardware omitted for clarity.
Figure 5:
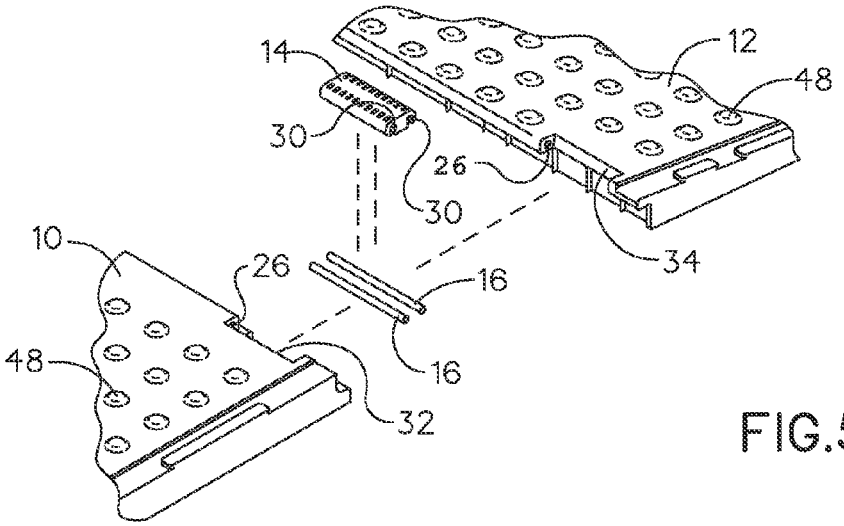
FIG. 5 is a detail exploded view of an embodiment of the invention.

One of the advantages of the pedestrian bridge is its modular nature, which is shown in more detail in FIG. 4 and FIG. 5. Front ramp 12 further comprises front ramp hinge slots 34. Bridge 10 further comprises front bridge hinge slots 32. Front hinge 14 fits between front ramp hinge slot 34 and front bridge hinge slot 32. Front hinge 14 is then joined by inserting front ramp side hinge rod 16 through front ramp hinge slot 34 and inserting front bridge side hinge rod 16 through front bridge hinge slot 32. Likewise, rear ramp 12 further comprises rear ramp hinge slots 34. Bridge 10 further comprises rear bridge hinge slots 32. Rear hinge 14 fits between rear ramp hinge slot 34 and rear bridge hinge slot 32. Rear hinge 14 is then joined by inserting rear ramp side hinge rod 16 through rear ramp hinge slot 34 and inserting rear bridge side hinge rod 16 through rear bridge hinge slot 32. Bridge 10 can be laterally supported by inserting support bars 18 into cross bar slots 36.

Figure 6:
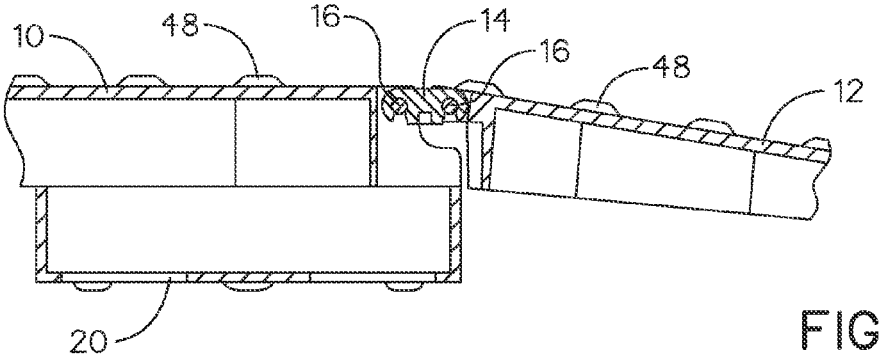
FIG. 6 is a section view of an embodiment of the invention, taken along line 5-5 in FIG. 1.
Figure 7:
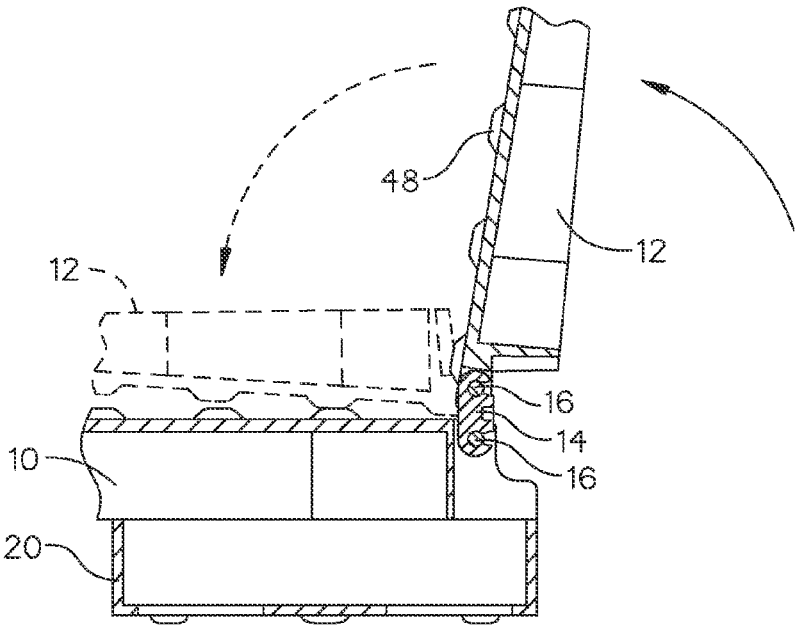
FIG. 7 is a section view of an embodiment of the invention, illustrating the folding of the ramps

Turning to FIG. 6 and FIG. 7, front ramp 12 can be folded up and over bridge 10. This is caused by hinge 14 rotating approximately 90 degrees (counterclockwise in this instance). This creates a level surface while front ramp 12 is down. Rear ramp 12 is likewise operable.

Figure 8:
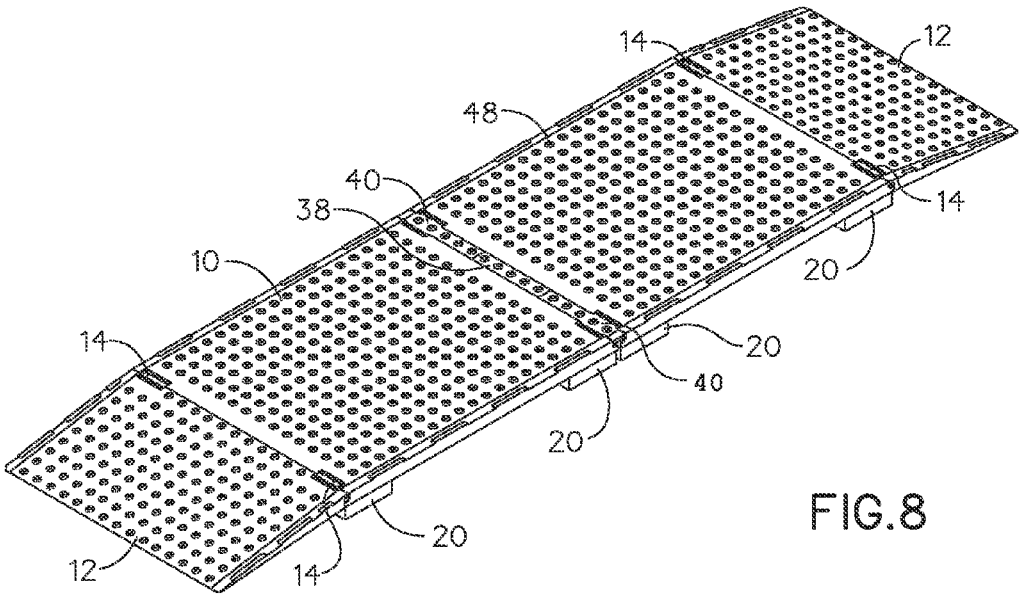
FIG. 8 is a perspective view of an embodiment of the invention extended with connectors.
Figure 9:
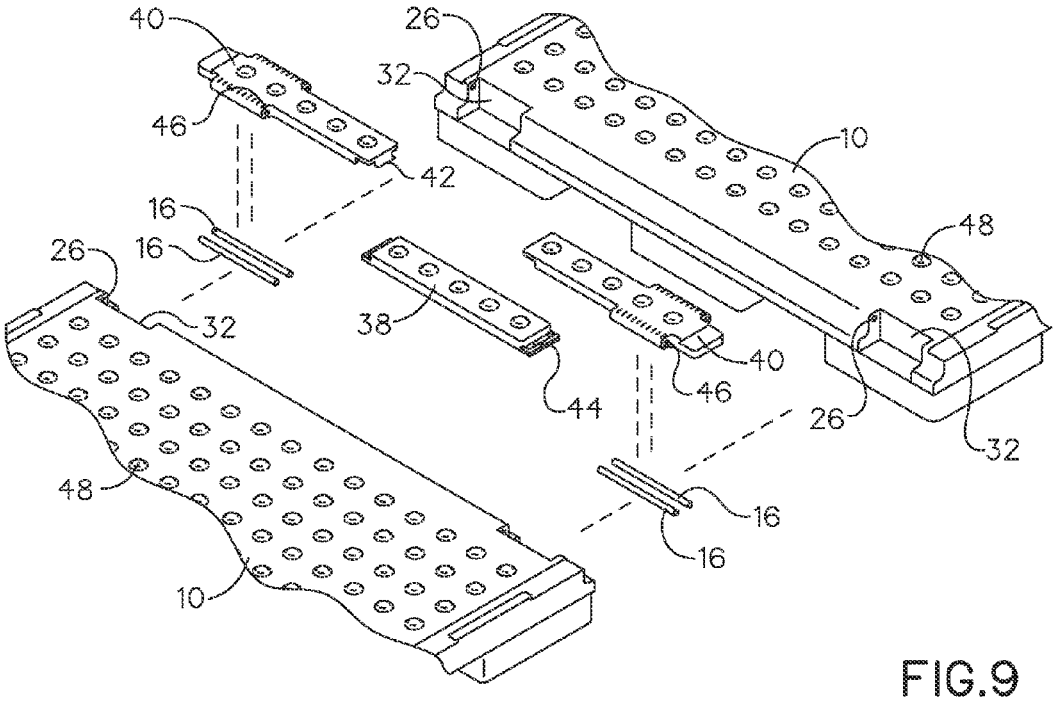
FIG. 9 is a detail exploded view of the connectors and bridges.

As shown in FIG. 8 and FIG. 9, the pedestrian bridge is expandable by adding a second bridge 10, or additional bridges 10 as desired by a user. To do this end connector 40 is inserted into the first bridge front hinge slot 32 as well as into second bridge rear hinge slot 32. End connector 40 further comprises front connector slot 46, rear connector slot 46, and connector tab 42. Then, first bridge front hinge rod 16 is inserted through first bridge front hinge rod hole 26 and into front connector slot 46. After that, second bridge rear hinge rod 16 is inserted through second bridge rear hinge rod hole 26 and into rear connector slot 46. Connector tab 42 then can be joined with center connector first tab 44 on center connector 38. Center connector 38 further comprises center connector second tab 44 which can be joined to second end connector 40. Second end connector 40 can be joined to first bridge 10 and second bridge 10 in substantially the same manner as the first end connector.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A pedestrian bridge, configured to be portable and expandable; the pedestrian bridge comprising:

a bridge, further comprising a plurality of bridge rows and columns including cross bar slots, mechanically coupled to at least one foot offset from edges on the distal bridge row and the distal bridge column and configured to be elevated above standing water; wherein the plurality of bridge rows and columns are configured to trap air increasing buoyancy of the bridge;

a front ramp, further comprising a plurality of front ramp rows and columns, rotatably coupled to the bridge and configured to be folded upon the bridge making the pedestrian bridge portable; wherein the plurality of front ramp rows and columns are configured to trap air increasing the buoyancy of the front ramp; wherein the front ramp is further mechanically coupled to front ramp feet offset from edges on the distal front ramp row and distal front ramp column; and a rear ramp, further comprising a plurality of rear ramp rows and columns, rotatably coupled to the bridge and configured to be folded upon the bridge further making the pedestrian bridge portable; wherein the plurality of rear ramp rows and columns are configured to trap air increasing the buoyancy of the rear ramp; wherein the rear ramp is further mechanically coupled to rear ramp feet offset from edges on the distal rear ramp row and distal rear ramp column;

wherein the rows and cross bar slots run in a first direction from the front ramp to the rear ramp and the columns run in a direction perpendicular to the rows; and a support bar, inserted into each cross bar slot and confined between the distal bridge row and the distal bridge column and configured to provide lateral support for the bridge.

2. The pedestrian bridge of claim 1, the bridge further comprises a bridge top side and a bridge bottom side; the front ramp further comprises a front ramp top side and a front ramp bottom side; and the rear ramp further comprises a rear ramp top side and a rear ramp bottom side;

wherein the bridge top side, front ramp top side, and rear ramp top side are each mechanically coupled to grip nubs.

3. The pedestrian bridge of claim 2, wherein the front ramp feet are mechanically coupled to the front ramp bottom side; and wherein the rear ramp feet are mechanically coupled to the rear ramp bottom side.

4. The pedestrian bridge of claim 1, a front ramp hinge slot configured within the front ramp;

a front bridge hinge slot configured within the bridge; and a front hinge joined to the front ramp hinge slot with a front ramp hinge rod and joined to the front bridge hinge slot with a front bridge hinge rod.

5. The pedestrian bridge of claim 4, a rear ramp hinge slot configured within the rear ramp;

a rear bridge hinge slot configured within the bridge; and a rear hinge joined to the rear ramp hinge slot with a rear ramp hinge rod and joined to the rear bridge hinge slot with a rear bridge hinge rod.

* * * * *